US007134495B2

(12) United States Patent
Vloedman et al.

(10) Patent No.: US 7,134,495 B2
(45) **Date of Patent: *Nov. 14, 2006**

(54) APPARATUS AND METHOD FOR LINING A DOWNHOLE CASING

(76) Inventors: Jack Vloedman, 13715 Ashley Run, Houston, TX (US) 77077; Harold Robinson Wesson, Jr., 844 Cardinal Creek Blvd., Norman, OK (US) 73072

( * ) Notice: Subject to any disclaimer, the term of this patent is extended or adjusted under 35 U.S.C. 154(b) by 0 days.

This patent is subject to a terminal disclaimer.

(21) Appl. No.: 11/025,328

(22) Filed: Dec. 29, 2004

(65) Prior Publication Data

US 2005/0121204 A1 Jun. 9, 2005

Related U.S. Application Data

(63) Continuation of application No. 10/349,757, filed on Jan. 22, 2003.

(51) Int. Cl.
*E21B 33/00* (2006.01)

(52) U.S. Cl. ..... 166/277; 166/207; 166/384

(58) Field of Classification Search ..... 166/277, 166/350, 384, 207, 77.2; 285/909, 397, 385.1, 285/385.2, 385.3, 385.4, 385.5
See application file for complete search history.

(56) References Cited

U.S. PATENT DOCUMENTS 3,191,677 A 6/1965 Kinley
3,424,244 A 1/1969 Kinley
3,477,506 A 11/1969 Malone
3,489,220 A 1/1970 Kinley
3,691,624 A 9/1972 Kinley
3,735,475 A 5/1973 Marriott
4,676,563 A 6/1987 Curlett et al.
4,683,944 A 8/1987 Curlett
4,836,305 A 6/1989 Curlett
4,924,949 A 5/1990 Curlett
5,072,622 A 12/1991 Roach et al.
5,454,419 A 10/1995 Vloedman
5,957,195 A 9/1999 Bailey et al.
6,220,079 B1 4/2001 Taylor et al.
6,283,211 B1 9/2001 Vloedman
2003/0217844 A1 11/2003 Moyes

*Primary Examiner*—William Neuder
(74) *Attorney, Agent, or Firm*—Dunlap, Codding & Rogers, P.C.

(57) ABSTRACT

A casing liner and method for lining a casing affixed in a well bore. The casing liner having a plurality of grooves and ridges arranged longitudinally and in an alternating relationship about the exterior surface of the casing liner to increase stress storage upon the casing liner being radially reduced in size and thereby decrease the expansion rate of the casing liner and facilitate installation of the casing liner into the casing.

41 Claims, 3 Drawing Sheets

APPARATUS AND METHOD FOR LINING A DOWNHOLE CASING

CROSS REFERENCE TO RELATED APPLICATIONS

This application is a continuation of U.S. Ser. No. 10/349,757, filed Jan. 22, 2003.

BACKGROUND OF THE INVENTION

1. Field of the Invention

The present invention relates to a liner for a well bore, and more particularly, but not by way of limitation, to an improved apparatus and method for lining a casing affixed within a well bore.

2. Brief Description of Related Art

As the drilling of an oil or gas well progresses, the well bore is lined with a casing that is secured in place by a cement slurry injected between the exterior of the casing and the well bore. The casing commonly consists of steel tubulars joined by couplings and functions to provide a permanent well bore of known diameter through which drilling, production, or injection operations may be conducted. The casing also provides the structure for attaching surface equipment required to control and produce fluids from the well bore or for injecting fluids therein. In addition, the casing prevents the migration of fluids between subterranean formations through the well bore (e.g., the intrusion of water into oil or gas formations or the pollution of fresh water by oil, gas, or salt water).

Heat loss from produced fluids through the steel tubulars and couplings of the casing to the surrounding subterranean formations is relatively high due to the high thermal conductivity of steel and rock. Heat loss from the produced fluids can be problematic during production. For example, if a gas is produced through the steel tubulars, liquids condensing from the gas due to cooling can result in liquid dropout thereby causing a loss of valuable fluids and reducing the flow of the gas through the steel tubulars. Another problem may arise when temperature loss from the produced fluids induces the formation of scales, paraffin, or other deposits on the steel tubulars, thereby creating restrictions, or even a blockage, of the fluid flow through the steel tubulars.

Though vacuum insulated steel tubing offers sufficient insulation, heat loss from the couplings may reduce the total insulation quality significantly. Furthermore, couplings can create discontinuities along the flow path that result in increased friction and turbulence in the flow of produced fluids. Plastic liners have demonstrated insulation benefits and are more consistent than vacuum insulated steel tubing because they do not have couplings. Plastic liners are generally less expensive than vacuum insulated steel tubing; however, current plastic liners are not as effective in insulation benefits per foot as the vacuum insulated steel tubing.

A method of lining a casing with a continuous string of tubular polymeric material has previously been proposed. This method is disclosed in U.S. Pat. No. 5,454,419, issued to Jack Vloedman. The method disclosed in the Vloedman '419 patent utilizes a continuous, smooth walled polymeric tubular liner wound on a portable spool. The smooth walled liner has an outer diameter greater than the inner diameter of the casing and is reeled off the spool and through a roller reduction unit to reduce the diameter of the liner so that the liner can be injected into the casing. A weight system connected to the bottom end of the liner maintains the reduced liner in tension so that the liner remains in its reduced state until the liner is positioned at a desired depth. After the liner is run to such depth, the weights are removed thereby allowing the reduced liner to rebound and form a fluid tight seal with the casing and seal any breaches in the casing.

While the method disclosed in the Vloedman '419 patent has successfully met the need for lining and repairing breaches in a casing in an effective and time efficient manner, several inefficiencies have nevertheless been encountered, particularly when attempting to line a casing at depths below about 5,000 feet. In attempting to line a casing at depths below about 5,000 feet, the weight of the weight system coupled with the weight of the liner being run into the casing can cause the liner to plastically deform and exceed the yield strength resulting in permanent deformation.

SUMMARY OF THE INVENTION

The present invention is directed to a liner for lining a casing affixed within a well bore. The liner includes a polymeric pipe having a wall with an inner diameter, an outer diameter, an interior surface, and an exterior surface. The exterior surface of the pipe is provided with a plurality of grooves and ridges. The outer diameter of the polymeric pipe is reduceable by the application of radially compressive forces to the ridges so that the outer diameter of the polymeric pipe is less than the inner diameter of the casing. Reduction of the pipe creates point loads that cause the polymeric pipe to deform non-uniformly whereby stress induced to the polymeric pipe by the reduction thereof is stored in the polymeric pipe thereby decreasing the rate of expansion of the polymeric pipe and thus allowing the polymeric pipe to be inserted into the casing to a desired depth prior to the polymeric pipe expanding and engaging the internal wall of the casing.

The present invention is further directed to a liner for a well bore casing wherein the liner includes a polymeric tube having a wall with an inner diameter, an outer diameter, and an exterior surface having a plurality of alternating grooves and ridges extending longitudinally of the exterior surface and defining a substantially sinusoidal profile around the periphery of the exterior surface.

In another aspect, the present invention is directed to a method for lining a casing affixed within a well bore by reducing the outer diameter of a polymeric pipe having a wall with a plurality of ridges and grooves by applying radial compressive forces to the ridges so that the outer diameter of the polymeric pipe is less than the inner diameter of the of the casing. The application of compressive forces to the ridges creates point loads that cause the polymeric pipe to deform non-uniformly whereby stress induced to the polymeric pipe by the reduction thereof is stored in the polymeric pipe thereby delaying expansion of the polymeric pipe for a period of time. The reduced pipe is then passed into the casing to a predetermined depth. The stored stress of the reduced pipe is released so that the reduced pipe expands against the inner wall of the casing.

The present invention is also directed to a method for lining a casing affixed within a well bore by reducing the outer diameter of a polymeric pipe having a plurality of ridges and grooves by applying radial compressive forces to the ridges of the polymeric pipe and passing the reduced pipe, free of added weight on a lower end of the reduced pipe, into the casing to a predetermined depth such that the reduced pipe is void of longitudinal tension except for the tension placed on the reduced pipe by the weight of the polymeric pipe itself. The reduced pipe is then allowed to expand against the inner wall of the casing so that the ridges of the exterior surface of the polymeric pipe engage the internal wall of the casing.

Still yet, the present invention is directed to a method for lining a well bore casing by reducing the outer diameter of a tube having a plurality of alternating ridges and grooves extending longitudinally of the outer surface and defining a substantially sinusoidal profile around the periphery of the exterior surface by applying a compressive force to the outer wall sufficient to reduce the outer diameter of the tube between the elastic limit and the ultimate strength of the tube. The reduced tube is then passed into the well bore casing and permitted to expand toward the inner wall of the casing.

The objects, features, and advantages of the present invention will become apparent from the following detailed description when read in conjunction with the accompanying drawings and appended claims.

BRIEF DESCRIPTION OF THE SEVERAL VIEWS OF THE DRAWING

FIG. 6 is a diagrammatical illustration of a casing liner injector unit used in the method of the present invention.

DETAILED DESCRIPTION OF THE INVENTION

Figure 1:
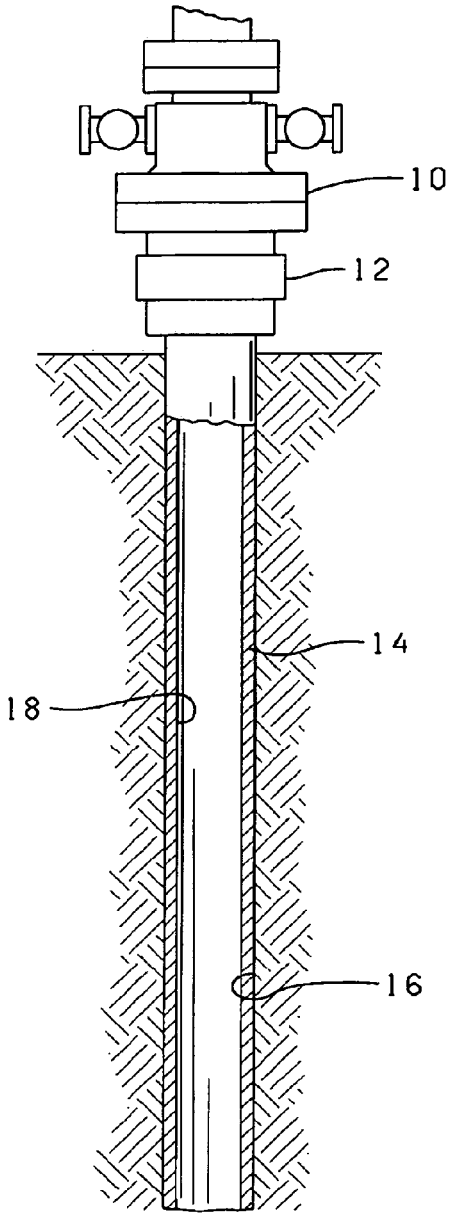
FIG. 1 is a cross sectional view of a well bore having a casing affixed therein.

Referring now to the drawings, and more specifically to FIG. 1, a typical wellhead 10 utilized in the production of oil and gas from a well is shown. The wellhead 10 includes a casing head 12 which functions to support a casing 14 which is extended down the well to provide a permanent borehole through which production operations may be conducted. The casing 14 is shown affixed in a well bore 16 in a conventional manner, such as by cement (not shown). The casing 14 is illustrated as having an internal wall 18 defining a flow area.

Figure 2:
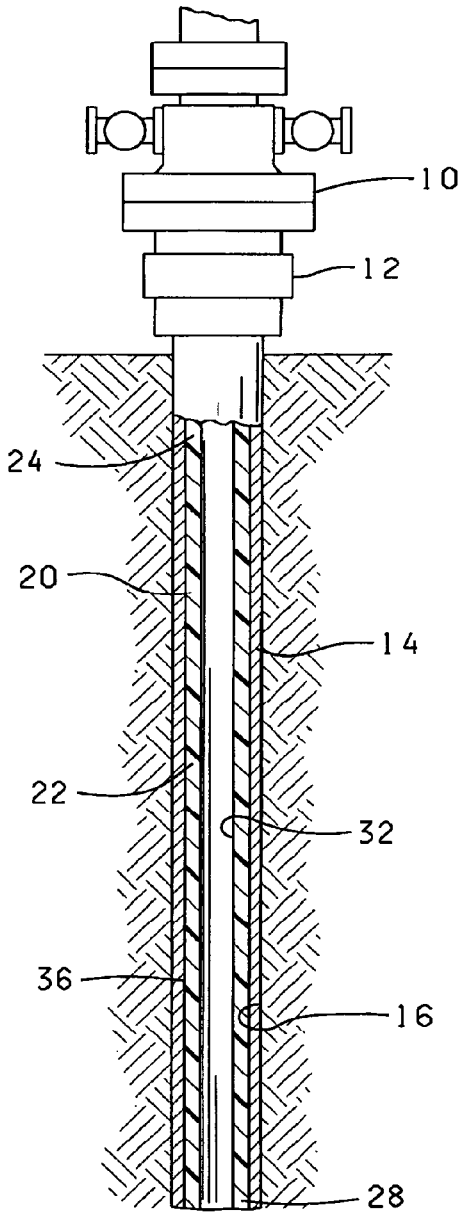
FIG. 2 is a cross sectional view of the well bore of FIG. 1 showing a casing liner of the present invention inserted into the casing.
Figure 3:
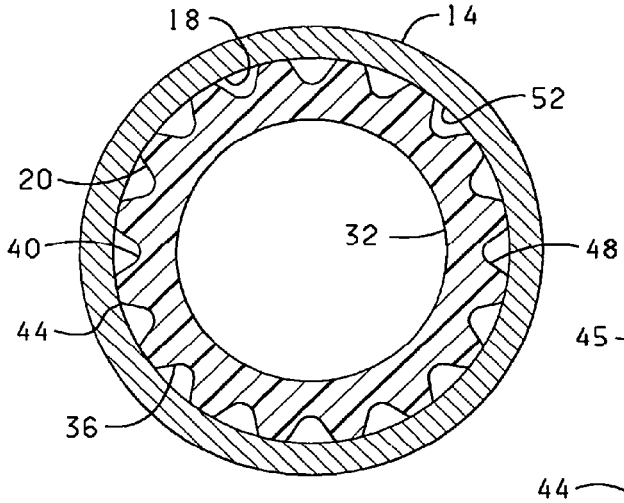
FIG. 3 is a cross sectional view of the casing liner of the present invention shown inserted into a casing.

FIG. 2 shows a casing liner 20 inserted in the casing 14 in accordance with the present invention. The casing liner 20 is characterized as a polymeric pipe 22 having an upper end 24, a lower end 28, an interior surface 32, and an exterior surface 36. As best shown in FIG. 3, the exterior surface 36 of the casing liner 20 is provided with a plurality of grooves 40 and ridges 44. More specifically, the ridges 44 of the exterior surface 36 of the casing liner 20 provide a contact area along the exterior surface 36 of the casing liner 20 that frictionally engages the internal wall 18 of the casing 14 while the grooves 40 of the exterior surface 36 of the casing liner 20 cooperate with the internal wall 18 of the casing 14 to form a plurality of cavities 48.

The casing liner 20 is fabricated of a tubular polymeric material which is compressible and has sufficient memory so as to permit the material to return to, or at least near to, its original shape after the compressive and tensile forces imparted by the casing liner installation process are removed from the material. More specifically, the tubular polymeric material is compressible in such a manner that the outer diameter of the casing liner 20 can be substantially reduced in size and the memory of the tubular polymeric material allows the material to rebound after a period of exposure to elevated pressures and temperatures experienced downhole. This capability of the diameter of the casing liner 20 to be downsized enables a tubular polymeric material having an outer diameter greater than the inner diameter of the casing 14 to be inserted into the casing 14. Alternatively, a tubular polymeric material having an outer diameter equal to or less than the inner diameter of the casing 14 can be inserted into the casing 14. As such, the outer diameter of the casing liner 20 preferably should be capable of being reduced up to about 25%. It will be understood that the reduction percentage must be sufficient to allow clearance and insertion of the casing liner 20 into the casing 14. Furthermore, the reduction percentage should be such that the casing liner 20 remains substantially in a reduced state during insertion into the casing 14 and then expands once the casing liner 20 is disposed at the desired depth within the casing 14. It will be understood that the reduction percentages and preferred range can vary depending on the material used to fabricate the casing liner 20.

When forming the casing liner 20 from a tubular polymeric material having an outer diameter greater than the inner diameter of the casing 14, the memory of the polymeric material causes the casing liner 20 to expand within the casing 14 such that the ridges 44 of the exterior surface 36 of the casing liner 20 presses against the internal wall 18 of the casing 14. Because the original outer diameter of the tubular polymeric material is greater than the inner diameter of the casing 14, the ridges 44 of the exterior surface 36 of the expanding tubular polymeric material presses tightly against the casing 14 and forms a plurality of frictionally engaged braces against the casing 14 while the grooves 40 of the exterior surface 36 of the expanding tubular polymeric material cooperate with the internal wall 18 of the casing 14 to form the plurality of cavities 48. Furthermore, the amount of polymeric material used in fabricating the casing liner 20 is reduced, thereby reducing the amount of material needed to form the casing liner 20 while the outer diameter of the casing liner 20 is effectively maintained. The casing liner 20 remains capable of expanding and engaging the internal wall 18 of the casing 14 while decreasing the weight of the casing liner 20 that is supported by the frictionally engaged braces against the casing 14. To this end, the casing liner 20 is secured against the casing 14 without the use of adhesives which have generally proven to be ineffective in downhole environments. Further, removal of the casing liner 20 from the casing 14, if necessary, is facilitated by the reduced area of contact between the casing liner 20 and the casing 14.

The thermal insulating property of the tubular polymeric material depends on the composition, thickness, and shape of the polymeric material. These factors limit the heat conduction area in contact with the casing wall. In particular, the cavities 48 increase the thermal insulating property of the tubular polymeric material so long as the cavities 48 are filled with a fluid that has less thermal conductivity than the tubular polymeric material itself. To this end, the plurality of cavities 48 formed by the grooves 40 of the exterior surface 36 of the casing liner 20 and the internal wall 18 of the casing 14 alter the thermal insulating property of the casing liner 20 installed in the casing 14. Due to the low coefficient of heat transfer for fluid accumulated in the cavities 48, the cavities 48 limit the heat conduction area of the casing liner 20 that is in contact with the casing 14. However, it should be appreciated that in instances where heat loss is tolerated, the casing liner 20 of the present invention can be utilized irrespective of the formation of cavities 48 between the grooves 40 of the exterior surface 36 of the casing liner 20 and the internal wall 18 of the casing 14. For example, the casing liner 20 can be utilized as a velocity string.

While the casing liner 20 of the present invention is described herein as serving as a thermal insulator when used alone within the casing 14, it will be recognized that the casing liner 20 is not limited to being used alone to thermally insulate the casing 14. For example, the casing liner 20 can be used in combination with a downhole heater to thermally insulate the casing 14.

Figure 4:
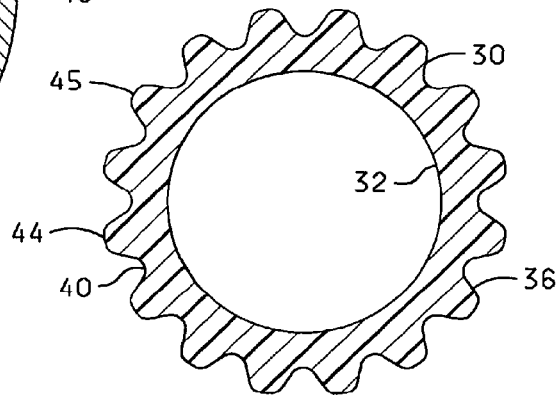
FIG. 4 is a cross sectional view of the casing liner of FIG. 3 shown in a non-reduced condition.

The expansion rate of the casing liner 20 is a function of thermal expansion and stored stress in the polymeric material that results from reduction of the outer diameter of the casing liner 20. The storage of stress and the amount of stored stress is a function of the strength and shape of the polymeric material, temperature, and the extent of the induced reduction. To alter the expansion rate of the polymeric material of the casing liner 20, the grooves 40 and the ridges 44 of the exterior surface 36 of the casing liner 20 are arranged in an alternating relationship about the circumference of the exterior surface 36 of the casing liner 20. As best shown in FIG. 4, the grooves 40 and the ridges 44 of the exterior surface 36 of the casing liner 20 are curved and form a substantially sinusoidal profile about the circumference of the exterior surface 36 of the casing liner 20. Such a profile results in the grooves 40 and the ridges 44 being shaped and dimensioned substantially similarly to each other and each of the ridges 44 being contiguous to the adjacent ridges 44 whereby the outer diameter of the casing liner 20 can be reduced so that the stress induced to the casing liner 20 during reduction can be stored, and later released while minimizing the amount of reduction necessary to maintain the casing liner 20 in the reduced state. To avoid inflicting undue stress to the ridges 44 during the reduction process, the casing liner 20 is formed so that the ridges 44 are truncated to provide the ridges 44 with a substantially flat end surface 45.

Figure 4A:
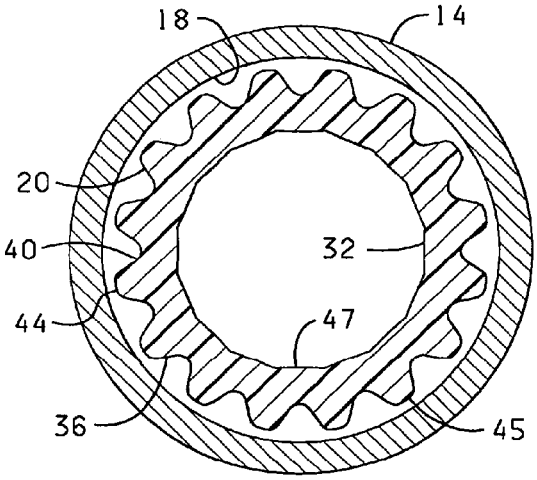
FIG. 4A is a cross sectional view of the casing liner of FIG. 4 shown in a reduced condition and inserted in the casing.
Figure 4B:
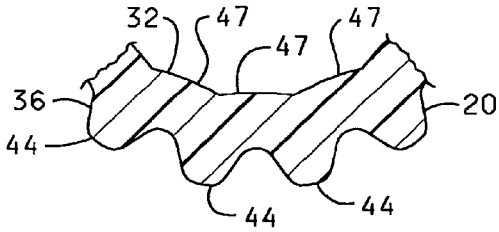
FIG. 4B is an enlarged view of a portion of the casing liner of FIG. 4A.

FIG. 4A illustrates the casing liner 20 in a reduced state and inserted in the casing 14. The alternating arrangement of the grooves 40 and the ridges 44 along the exterior surface 36 of the casing liner 20 result in the wall of the casing liner 20 having a non-uniform thickness. The application of radially compressive forces to the ridges 44 during the installation process creates point loads that deform the casing liner 20 non-uniformly due to the non-uniform thickness of the casing liner 20. More particularly, the portions of the casing liner 20 corresponding to the lowest point of the grooves 40 are the thinnest portions of the casing liner 20, and the portions of the casing liner 20 corresponding to the peak of the ridges 44 are the thickest portions of the casing liner 20. Upon the application of radially compressive forces to the ridges 44, the thinner portions of the casing liner 20 deform to a greater degree than the thicker portions of the casing liner 20, as best illustrated in FIG. 4B by the formation of internal ridges 47 on the internal surface 32 of the casing liner 20. The internal ridges 47 correspond to the thinner portions of the casing liner 20.

To decrease the expansion rate of the reduced casing liner 20, the casing liner 20 is reduced by the application of compressive forces on the casing liner 20 sufficient to deform the casing liner 20 between the elastic limit and the ultimate strength of the casing liner 20. The elastic limit is defined herein as being the amount of stress that will cause permanent or semi-permanent set to a material. The ultimate strength is defined herein as being the maximum stress a material can sustain before rupture calculated on the basis of the ultimate load in original or unstrained dimensions. By deforming the casing liner 20 between its elastic limit and ultimate strength, the casing liner 20 is caused to hold its reduced size and shape. However, upon exposure for a period of time to elevated temperatures and internal pressures encountered in a downhole environment or axial compression or mechanical swedging, the stresses in the casing liner 20 are released, and the casing liner 20 is caused to rebound toward its original shape and size. It will be understood that the elastic limit and the ultimate strength vary depending on the material used to form the casing liner 20, as well as the shape and thickness of the sidewall of the casing liner 20. Therefore, the amount of radial reduction required to the casing liner 20 to delay expansion of the casing liner 20 is a function of the type of material used to form the casing liner 20 and the size and shape of the casing liner 20.

For example, a casing having an outer diameter of 5.5 inches has an inner diameter of approximately 4.95 inches. As such, a casing liner having an outer diameter of 4.75 to 5.25 inches might be used to line the casing depending on whether a tight, neutral, or loose fit is desired. Assuming the casing liner has a shape as shown in FIG. 4, an outer diameter of 5.25 inches and a wall thickness of 0.35 inches (at the grooves) and is fabricated of a crosslinkable polyethylene, such as commercially available from Solvay and sold under the trademark ChemPEX®, the outer diameter of the casing liner would be reduced at least 13% to set the shape of the casing liner so that it may be inserted into the casing. However, a casing liner having a shape as shown in FIG. 4, an outer diameter of 5.25 inches and a wall thickness of 0.25 inches (at the grooves) and fabricated of a modified nylon six, such as commercially available from Honeywell and sold under the trademark CAPRON®, would require reduction of approximately 18–20% to set the shape of the casing liner so that it may be inserted into the casing.

The non-uniform deformation of the casing liner 20 that results from the grooves 40 and the ridges 44 of the exterior surface 36 of the casing liner 20 allows for more storage of stress in the polymeric material than is possible with a smooth wall liner of similar internal and external diameter and which is reduced approximately the same percentage. Without deforming the entire liner beyond its elastic limit, a smooth wall liner expands or rebounds too rapidly to allow it to be inserted into a well bore to great depths without the use of weights to keep the smooth wall liner in tension so that the outer diameter of the smooth wall liner remains reduced during insertion of the smooth wall liner into the well bore. However, because a smooth wall liner of comparable inner and outer diameter to the casing liner 20 has a uniform thickness, and thus a greater cross-sectional area than the casing liner 20, a greater compressive force is required to deform the smooth wall liner beyond its elastic limit than that required to deform the casing liner 20 beyond its elastic limit. Consequently, deforming a smooth wall liner beyond its elastic limit so that the smooth wall liner will hold its reduced shaped requires a greater percentage of reduction than that required of the casing liner 20. The problem encountered is that a smooth wall liner reduced sufficiently to hold its shape without the use of weight may not expand adequately to provide the desired internal flow area or to frictionally engage the casing even after exposure to elevated temperatures and pressures or the application of axial compressive forces. To this end, the increased stored stress in the polymeric material due to the formation of the grooves 40 and the ridges 44 on the exterior surface 36 of the casing liner 20 decreases the expansion rate and provides sufficient time to insert the casing liner 20 into the casing 14, and yet allows the casing liner 20 to adequately expand after it has been positioned at the desired depth within the casing 14 and exposed to elevated downhole temperatures, pressures, or mechanical forces, thereby eliminating the need of weights to keep the polymeric material in tension. As such, the added complexities and inherent dangers associated with using weights when inserting a tubular polymeric material into the casing 14 of the well bore 16 are eliminated.

While the casing liner 20 of the present invention is described herein as being insertable into the casing 14 without the use of weights, it will be recognized that the casing liner 20 is not limited to being inserted into the casing 14 without the use of weights. The casing liner 20 can be inserted into the casing 14 with the use of weights as disclosed in U.S. Pat. No. 5,454,419 issued to Jack Vloedman on Oct. 3, 1995, which is hereby expressly incorporated herein by reference, or any other applied axial loads that keep the polymeric material in tension while the casing liner 20 is being inserted into the casing 14, and then allowed to subsequently expand by releasing the applied tension loads. Furthermore, it will be recognized that in addition to expanding the casing liner 20 by releasing the applied tension loads, the casing liner 20 may also be expanded by action of temperature and internal pressure or mechanical tools, such as a device known as a swedge.

In one embodiment, the grooves 40 and the ridges 44 of the exterior surface 36 of the casing liner 20 extend longitudinally between the upper end 24 of the casing liner 20 and the lower end 28 of the casing liner 20 and are arranged such that the cavities 48 that result when the casing liner 20 is disposed and expanded in the casing 14 (FIG. 3) provide at least one continuous conduit 52 extending between the upper end 24 of the casing liner 20 and the lower end 28 of the casing liner 20 so that a fluid can flow between the upper end 24 of the casing liner 20 and the lower end 28 of the casing liner 20. The continuous conduit 52 provides for convenient transport of well treatment fluids, such as soap, or equipment, such as sensors, down the casing 14 to the well reservoir without using the flow area of the casing liner 20.

The longitudinal arrangement of the grooves 40 and the ridges 44 ensures that the plurality of grooves 40 and the ridges 44 along the exterior surface 36 of the casing liner 20 do not adversely effect the tensile strength of the tubular polymeric material. While the grooves 40 and the ridges 44 of the exterior surface 36 of the casing liner 20 of the present invention are described herein as being arranged such that the grooves 40 and the ridges 44 of the exterior surface 36 of the casing liner 20 extend longitudinally between the upper end 24 of the casing liner 20 and the lower end 28 of the casing liner 20, it will be recognized that the grooves 40 and the ridges 44 are not limited to a longitudinal arrangement. The grooves 40 and the ridges 44 may be arranged in any direction, so long as the grooves 40 and the ridges 44 do not adversely affect the tensile strength of the tubular polymeric material and provide for cavites and frictional engagement. For example, the grooves 40 and the ridges 44 of the exterior surface 36 of the casing liner 20 could extend helically between the upper end 24 of the casing liner 20 and the lower end 28 of the casing liner 20.

Figure 5:
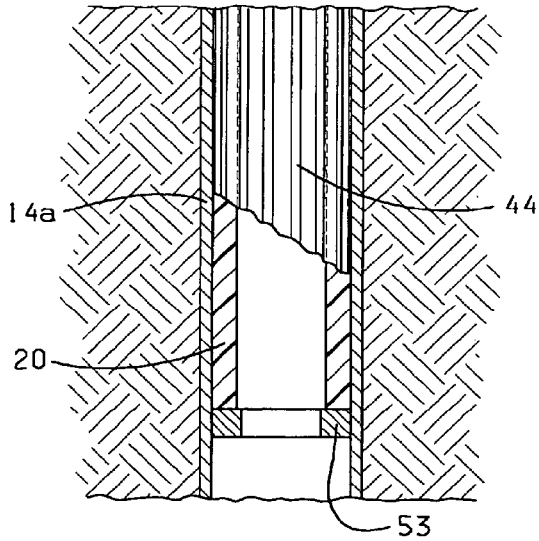
FIG. 5 is a partially cutaway, cross-sectional view of the casing liner shown supported in another casing.
Figure 5:
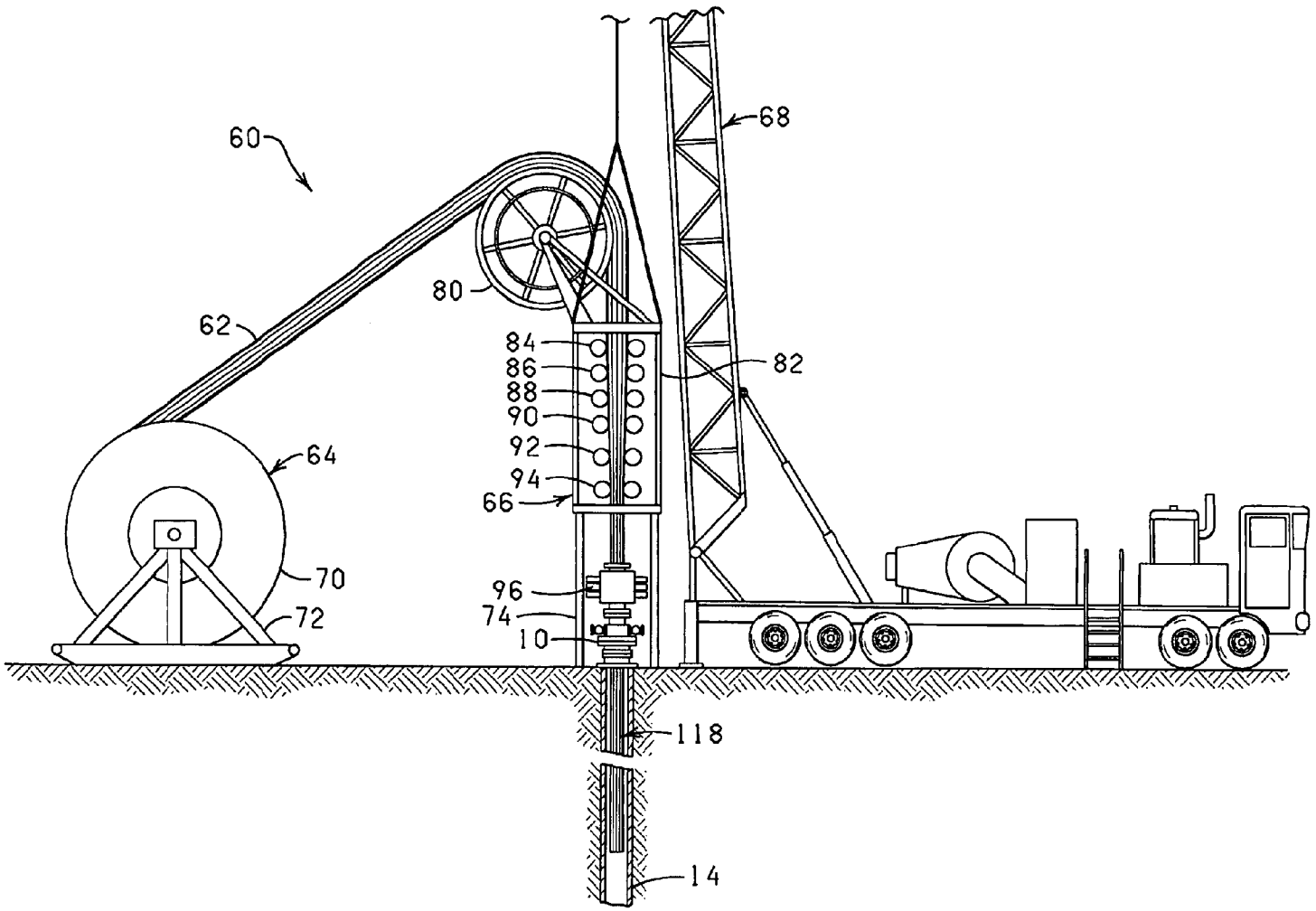

Referring now to FIG. 5, the casing liner 20 is shown inserted into a casing 14*a*. As mentioned above, the casing liner 20 of the present invention is not limited to having an outer diameter greater than the inner diameter of the casing. That is, the casing liner 20 may have an outer diameter substantially equal to the inner diameter of the casing 14*a* in which case the casing liner 20 may have a neutral fit with respect to the casing 14*a*, or the casing liner 20 may have an outer diameter less than the inner diameter of the casing 14*a* in which case the casing liner 20 may have a loose fit with respect to the casing 14*a*. In either case, the casing liner 20 is preferably downsized to facilitate insertion of the casing liner 20 into the casing 14*a*. The reduction percentage should be such that the casing liner 20 remains substantially in a reduced state during insertion into the casing 14*a* and then substantially expands once the casing liner 20 is disposed at the desired depth within the casing 14*a*. Because the casing liner 20 has an initial diameter equal to or less than the inner diameter of the casing 14*a*, the casing liner 20 can generally be inserted to greater depths without the use of weights and without concern that the casing liner 20 will expand prematurely so as to impede insertion of the casing liner 20.

When positioned at the desired depth, the casing liner 20 may expand to engage the casing 14*a* due to thermal expansion and the effects of internal pressure. However, the engagement may not be sufficient to support the weight of the casing liner 20. Accordingly, a flow-through packer or anchor 53 may be set at the desired depth in the casing 14*a*. The casing liner 20 is then downsized and inserted into the casing 14*a* until the casing liner 20 lands on the packer 53. The ridges 44 of the casing liner 20 form a stiffer column so that the casing liner 20 is able to resist compressive loading resulting from the casing liner 20 resting on the packer 53.

Suitable materials for the fabrication of the casing liner 20 are polyethylene, cross-linked polyethylene, polypropylene, polyamides, polyketones, and copolymers thereof. In addition to the compression and memory characteristics mentioned above, these materials are resistant to abrasion, which enables them to withstand the passage of downhole tools, and are resistant to various chemical and salt water corrosion. These materials are readily shapeable, which allows them to be fabricated such that the interior surface 32 of the casing liner 20 is smooth and the exterior surface 36 of the casing liner 20 is provided with a plurality of grooves 40 and the ridges 44. Furthermore, these materials can be formed into a long, continuous joint containing no joint connections. Coupling connections in standard steel tubular casings create discontinuities along the flow area of the casing 14 that result in increased friction and turbulence in the flow of produced fluids. By lining the casing 14 with a continuous joint of material which is accomplished as a result of the ability of the these materials to be fused, the flow area of the casing 14 utilized for production is effectively continuous and smooth. The casing liner 20 can also be fabricated with a predetermined inner diameter. As the pressure in a well reservoir depletes, there may be insufficient velocity to transport all liquids from the well bore 16 thereby impairing production. By lining the casing 14 with a pipe made from these materials or others with an inner diameter that reduces the flow area of the casing 14 being utilized for production, the flow velocity of the casing 14 is effectively increased thereby enabling liquids to be transported from the well bore 16.

While these materials are described herein as the materials of preference for the fabrication of the casing liner 20 of the present invention, it will be recognized that the casing liner 20 is not limited to being fabricated of these materials. The casing liner 20 can be fabricated of any durable, polymeric material that is capable of withstanding temperatures and pressures typically encountered in oil and gas wells, compatible with produced and treatment fluids, and has compression and memory properties that allow it to be downsized for insertion into the casing 14 or 14*a* and subsequently permit it to expand to near its original shape.

Referring now to FIG. 6, an injector unit 60 constructed in accordance with the present invention for injecting a tubular polymeric material, such as a coiled polymeric pipe 62, into the casing 14 in order to form the casing liner 20 (FIG. 2) is schematically illustrated. The injector unit 60 includes a reel 64 for handling and storing the coiled polymeric pipe 62 and a roller reduction unit 66 for directing the pipe 62 into the casing 14, reducing the diameter of the pipe 62 to the desired diameter, and injecting the reduced pipe 62 into the casing 14 to form the casing liner 20. A conventional workover rig 68 is also utilized in the process of positioning the pipe 62 in the casing 14. As an alternative to the workover rig 68, other lifting and supporting structures, such as a crane, can be employed. The reel 64 includes a spool 70 rotatably mounted to a frame 72. The frame 72 is set on a suitable support surface such as the ground (FIG. 6), a trailer, or offshore platform deck.

The roller reduction unit 66 is supported above the wellhead 10 by a support structure 74. The workover rig 68 is also connected to the roller reduction unit 66 so as to cooperate with the support structure 74 to support the roller reduction unit 66 above the wellhead 10. The connection of the workover rig 68 to the roller reduction unit 66 further facilitates the rigging up and the rigging down of the roller reduction unit 66 by enabling the roller reduction unit 66 to be moved from a trailer (not shown) to its position over the wellhead 10 and back to the trailer once the injection process is completed.

The roller reduction unit 66 includes a guide wheel 80 and a support frame 82. The support frame 82 supports several banks of rollers 84, 86, 88, 90, 92, and 94 which are each journaled to the frame 82. The rollers in each bank 84–94 are arranged to form a substantially circular passageway through which the pipe 62 is passed. Each subsequent bank of rollers 86–90 from the upper end to the lower end provides the passageway with a diameter smaller than the diameter provided by the previous bank of rollers 84 thereby cooperating to form a substantially frusto-conically shaped passageway such that the outer diameter of the pipe 62 will be gradually reduced as the pipe 62 is passed therethrough. As stated above, the banks of rollers 84–90 can be set up to reduce the outer diameter of the pipe 62 in a range of from 0 to about 25%. The portion of the passageway formed by the banks of rollers 92 and 94 provide the passageway with a diameter that is the same size as the portion of the passageway formed by the banks of roller 90 and thus the banks of rollers 90, 92, and 94 are adapted to frictionally engage the reduced pipe 62 to provide the thrust to snub the reduced pipe 62 into the casing 14 and to control the rate of entry into the casing 14. To this end, each bank of rollers 84–94 is controlled by a hydraulic motor (not shown). The hydraulic motors are used to control the insertion rate of the pipe 62 into the casing 14 with respect to injection, as well as braking of the pipe 62.

An alternative for controlling the insertion rate of the pipe 62 into the casing 14, as well as braking of the polymeric pipe 62 involves the use of an injector head in a manner described in U.S. Pat. No. 5,454,419, issued to Jack Vloedman on Oct. 3, 1995, which is hereby expressly incorporated herein by reference.

The roller reduction injector unit 66 is supported an elevated position above the wellhead 10 with support structure 74 which can include a plurality of telescoping legs or other suitable device such a hydraulic jack stand. It should be noted that the roller reduction injector unit 66 should be elevated sufficiently above the wellhead 10 to permit access to the wellhead 10 during the pipe injection process and to accommodate additional equipment, such as a blow out preventer 96.

Roller reduction units as briefly described above are well known in the art. Thus, no further description of their components, construction, or operation is believed necessary in order for one skilled in the art to understand and implement the method of the present invention.

Regardless of the manner in which the polymeric pipe 62 is injected into the casing, the pipe 62 must remain in a reduced state as the pipe 62 is being injected into the casing 14 and until the pipe 62 is set at the desired depth. For example, with a reduction percentage of about 25%, the time period for the polymeric pipe 62 of a specifically designed original outer diameter to rebound is about twelve hours, though one of ordinary skill in the art will understand that this rebound time can vary depending on the depth and bottom hole temperature of the well bore 16. Therefore, the polymeric pipe 62 should be inserted into the casing 14 such that the pipe 62 remains substantially reduced during insertion into the casing 14 and then substantially expands once the pipe 62 is disposed at the desired depth within the casing 14. The insertion time is generally between about four and eight hours once the reduction process begins. However, one of ordinary skill in the art will understand that the rebound time period and insertion time period can vary depending on the depth of insertion, the material, reduction percentage, and environmental temperature of the casing liner 20.

Before the pipe 62 is inserted into the casing 14 to provide the casing liner 20, the casing 14 is cleaned with a brush or scrapper to remove debris such as cement. The well is then killed by injecting KCl, inserting a bridge plug downhole, or other methods of killing a well. The pipe 62 is then fed over the guide wheel 80 and into the roller reduction unit 66. The roller reduction unit 66 is operated to inject the pipe 62 into the casing 14, as illustrated in FIG. 6. After the pipe 62 is run a distance into the casing 14, the roller reduction unit 66 is operated as a braking system to control the rate of descent of the pipe 62 due to the weight of the pipe 62.

Once the pipe 62 is run to the desired depth in the casing 14, the pipe 62 is allowed to expand into position against the casing 14 thereby effectively lining the casing 14. Next, the pipe 62 is cut and fused to a flange which is, in turn, attached to the wellhead 10. Alternatively, if the casing liner 20 is set on an anchor, such as anchor 53, the pipe 62 can be cut and fused to a flange prior to allowing the pipe 62 to expand.

As an alternative to allowing the pipe 62 to expand due to exposure to elevated downhole temperature and pressure, expansion of the pipe 62 can be induced by exposing the pipe 62 to an appropriate high temperature based on the characteristics of the material used to fabricate the pipe 62. This can be achieved by circulating a hot fluid through the pipe 62 after the pipe 62 is inserted and flanged to casing 14.

From the above description, it is clear that the present invention is well adapted to carry out the objects and to attain the advantages mentioned herein, as well as those inherent in the invention. While a presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A liner for lining a casing affixed within a well bore, the casing having an inner diameter and an internal wall, the liner comprising:

a polymeric pipe having a wall with an inner diameter, an outer diameter, an interior surface, and an exterior surface, the exterior surface provided with a plurality of grooves and ridges, the outer diameter of the polymeric pipe being reduceable by the application of radially compressive forces to the ridges so that the outer diameter of the polymeric pipe is less than the inner diameter of the casing and so that point loads are created that cause the polymeric pipe to deform non-uniformly whereby stress induced to the polymeric pipe by the reduction thereof is stored in the polymeric pipe thereby decreasing the rate of expansion of the polymeric pipe and thus allowing the polymeric pipe to be inserted into the casing to a desired depth prior to the polymeric pipe expanding and engaging the internal wall of the casing.

2. The liner of claim 1 wherein the grooves and the ridges of the polymeric pipe form a substantially sinusoidal profile.

3. The liner of claim 2 wherein the plurality of grooves and ridges of the exterior surface of the polymeric pipe are formed such that the grooves and the ridges of the exterior surface of the polymeric pipe extend longitudinally from an upper end of the polymeric pipe to a lower end of the polymeric pipe.

4. The liner of claim 1 wherein each of the ridges of the polymeric pipe is contiguous to the adjacent ridges.

5. The liner of claim 1 wherein the polymeric pipe has an elastic limit and an ultimate strength and wherein the polymeric pipe is reduceable between the elastic limit and the ultimate strength of the polymeric pipe.

6. A casing liner in combination with a casing affixed within a well bore, the casing having an inner diameter and an internal wall, the casing liner comprising:

a polymeric pipe having a wall with an inner diameter, an outer diameter, an interior surface, and an exterior surface, the exterior surface provided with a plurality of grooves and ridges, the outer diameter of the polymeric pipe reduced by the application of radially compressive forces to the ridges so that the outer diameter of the polymeric pipe is less than the inner diameter of the casing and so that point loads are created that cause the polymeric pipe to deform non-uniformly whereby stress induced to the polymeric pipe by the reduction thereof is stored in the polymeric pipe thereby decreasing the rate of expansion of the polymeric pipe, the polymeric pipe inserted into the casing and expanded so that the ridges of the exterior surface of the polymeric pipe engage the internal wall of the casing.

7. The combination of claim 6 wherein the outer diameter of the polymeric pipe is initially greater than the inner diameter of the casing.

8. The combination of claim 6 wherein the grooves and the ridges of the polymeric pipe form a substantially sinusoidal profile.

9. The combination of claim 6 wherein each of the ridges of the polymeric pipe is contiguous to the adjacent ridges.

10. The combination of claim 6 wherein the polymeric pipe has an elastic limit and an ultimate strength and wherein the polymeric pipe is reduced between the elastic limit and the ultimate strength of the polymeric pipe.

11. The combination of claim 6 wherein the grooves of the polymeric pipe provide a plurality of cavities between the external surface of the polymeric pipe and the internal wall of the casing.

12. The combination of claim 11 wherein the plurality of grooves and ridges of the exterior surface of the polymeric pipe are formed such that the grooves and the ridges of the exterior surface of the polymeric pipe extend longitudinally between an upper end of the polymeric pipe and a lower end of the polymeric pipe whereby the cavities extend continuously from the upper end of the polymeric pipe to the lower end of the polymeric pipe.

13. A liner for a well bore casing comprising:

a polymeric tube having an inner diameter, an outer diameter, an interior surface, an exterior surface, and a plurality of alternating ridges and grooves extending longitudinally of the exterior surface of the tube and defining a substantially sinusoidal profile around the periphery of the exterior surface.

14. The liner of claim 13, wherein the polymeric tube has a resiliency, an elastic limit and an ultimate strength, which when the tube is subjected to compressive forces between the elastic limit and the ultimate strength, the outer diameter of the tube will be reduced for insertion of the liner into a well casing, and the tube will ultimately rebound at or near to the outer diameter.

15. The liner of claim 14, wherein the ridges and grooves are parallel to a longitudinal axis of the tube along the length of the tube.

16. The liner of claim 13, wherein the tube is formed of a material selected from the group consisting of polyethylene, polypropylene, polyamide, polyketone and copolymers thereof.

17. A method for lining a casing affixed within a well bore, comprising the steps of:

providing a polymeric pipe having a wall with an inner diameter, an outer diameter, an interior surface, and an exterior surface, the exterior surface provided with a plurality of grooves and ridges;

reducing the outer diameter of the polymeric pipe by applying radial compressive forces to the ridges so that the outer diameter of the polymeric pipe is less than the inner diameter of the of the casing and so that point loads are created that cause the polymeric pipe to deform non-uniformly whereby stress induced to the polymeric pipe by the reduction thereof is stored in the polymeric pipe thereby delaying expansion of the polymeric pipe for a period of time;

passing the reduced pipe into the casing to a predetermined depth; and releasing the stored stress of the reduced pipe so that the reduced pipe expands against the inner wall of the casing.

18. The method of claim 17 wherein the outer diameter of the polymeric pipe is initially greater than the inner diameter of the casing.

19. The method of claim 17 wherein the step of providing the polymeric pipe further comprises forming the plurality of grooves and ridges of the exterior surface of the polymeric pipe such that the grooves and the ridges form a substantially sinusoidal profile.

20. The method of claim 17 wherein the step of providing the polymeric pipe further comprises forming the plurality of grooves and ridges of the exterior surface of the polymeric pipe such that each of the ridges is contiguous to the adjacent ridges.

21. The method of claim 17 wherein the step of providing the polymeric pipe further comprises forming the plurality of grooves and ridges of the exterior surface of the polymeric pipe such that the grooves and the ridges extend longitudinally between an upper end of the polymeric pipe and a lower end of the polymeric pipe whereby the cavities extend continuously from the upper end of the polymeric pipe to the lower end of the polymeric pipe.

22. The method of claim 17 wherein the polymeric pipe has an elastic limit and an ultimate strength and wherein the polymeric pipe is reduced between the elastic limit and the ultimate strength of the polymeric pipe.

23. The method of claim 17 wherein the step of releasing the stored stress of the reduced pipe further comprises exposing the polymeric pipe to elevated downhole temperatures to cause thermal expansion of the reduced pipe.

24. The method of claim 17 wherein the step of releasing the stored stress of the reduced pipe further comprises mechanically applying internal pressure to the reduced pipe.

25. The method of claim 17 wherein the step of releasing the stored stress of the reduced pipe further comprises exposing the internal surface of the reduced pipe to elevated downhole pressure.

26. The method of claim 17 wherein the ridges of the polymeric pipe frictionally engage the internal wall of the casing.

27. A method for lining a casing affixed within a well bore, comprising the steps of:

providing a polymeric pipe having a wall with an inner diameter, an outer diameter, an interior surface, and an exterior surface, the exterior surface provided with a plurality of grooves and ridges;

reducing the outer diameter of the polymeric pipe by applying radial compressive forces to the ridges of the polymeric pipe;

passing the reduced pipe, free of added weight on a lower end of the reduced pipe, into the casing to a predetermined depth such that the reduced pipe is void of longitudinal tension except for the tension placed on the reduced pipe by the weight of the polymeric pipe itself; and allowing the reduced pipe to expand against the inner wall of the casing so that the ridges of the exterior surface of the polymeric pipe engage the internal wall of the casing.

28. The method of claim 27 wherein the step of reducing the polymeric pipe, creates point loads that cause the polymeric pipe to deform non-uniformly whereby stress induced to the polymeric pipe by the reduction thereof is stored in the polymeric pipe thereby decreasing the rate of expansion of the polymeric pipe and thus allowing the polymeric pipe to be inserted into the casing to a desired depth prior to the polymeric pipe expanding and engaging the internal wall of the casing.

29. The method of claim 28 further comprising releasing the stored stress of the reduced pipe by mechanically applying internal pressure to reduced pipe.

30. The method of claim 28 further comprising releasing the stored stress of the reduced pipe by exposing the internal surface of the reduced pipe to elevated downhole pressure.

31. The method of claim 27 wherein the ridges of the polymeric pipe frictionally engage the internal wall of the casing.

32. The method of claim 27 wherein the outer diameter of the polymeric pipe is initially greater than the inner diameter of the casing.

33. The method of claim 27 wherein the step of providing the polymeric pipe further comprises forming the plurality of grooves and ridges of the exterior surface of the polymeric pipe such that the grooves and the ridges form a substantially sinusoidal profile.

34. The method of claim 27 wherein the step of providing the polymeric pipe further comprises forming the plurality of grooves and ridges of the exterior surface of the polymeric pipe such that each of the ridges is contiguous to the adjacent ridges.

35. The method of claim 27 wherein the step of providing the polymeric pipe further comprises forming the plurality of grooves and ridges of the exterior surface of the polymeric pipe such that the grooves and the ridges extend longitudinally between an upper end of the polymeric pipe and a lower end of the polymeric pipe whereby the cavities extend continuously from the upper end of the polymeric pipe to the lower end of the polymeric pipe.

36. The method of claim 27 wherein the polymeric pipe has an elastic limit and an ultimate strength and wherein the polymeric pipe is reduced between the elastic limit and the ultimate strength of the polymeric pipe.

37. The method of claim 36 wherein the outer diameter of the polymeric pipe is reduced up to about 25%.

38. The method of claim 28 further comprising releasing the stored stress of the reduced pipe by exposing the polymeric pipe to elevated downhole temperatures to cause thermal expansion of the reduced pipe.

39. A method of lining a well bore casing comprising the steps of:

providing a resilient polymeric tube having an inner diameter, outer diameter, an interior surface, an exterior surface, and a plurality of alternating ridges and grooves extending longitudinally of the outer surface of the tube and defining a substantially sinusoidal profile around the periphery of the outer surface;

applying a compressive force between the elastic limit and the ultimate strength of the tube to the exterior surface of the tube to reduce the outer diameter of the tube;

inserting the reduced diameter tube into the well casing; and permitting the reduced diameter tube to expand toward an inner surface of the casing.

40. The method of claim 39, wherein the outer diameter of the tube is reduced by an amount sufficient to cause the tube to remain in a reduced diameter state during complete insertion of the tube into the casing.

41. The method of claim 40, wherein the outer diameter of the tube is reduced by up to 25%.

* * * * *